US008297669B2

(12) United States Patent
Matthews

(10) Patent No.: US 8,297,669 B2
(45) Date of Patent: Oct. 30, 2012

(54) BALL HOPPER AND METHOD OF USE THEREOF

(75) Inventor: Christopher Howard Matthews, Johns Creek, GA (US)

(73) Assignee: BallCollectors, LLC, Atlanta, GA (US)

( * ) Notice: Subject to any disclaimer, the term of this patent is extended or adjusted under 35 U.S.C. 154(b) by 215 days.

(21) Appl. No.: 12/758,179

(22) Filed: Apr. 12, 2010

(65) Prior Publication Data

US 2010/0193379 A1 Aug. 5, 2010

Related U.S. Application Data

(63) Continuation-in-part of application No. 12/108,211, filed on Apr. 23, 2008, now Pat. No. 7,753,420.

(51) Int. Cl.
*A63B 47/02* (2006.01)
*A47C 13/00* (2006.01)

(52) U.S. Cl. ..... 294/19.2; 297/129

(58) Field of Classification Search ..... 294/19.2; 206/315.9; 473/460; 56/328.1; 297/129, 297/118, 188.08
See application file for complete search history.

(56) References Cited

U.S. PATENT DOCUMENTS

| | | | | |
|---|---|---|---|---|
| 698,226 | A | 4/1902 | Roberts | |
| 771,886 | A | 10/1904 | Smith | |
| 2,516,622 | A * | 7/1950 | George | 56/328.1 |
| 3,258,286 | A * | 6/1966 | Coward | 294/19.2 |
| 3,889,996 | A | 6/1975 | Campbell | |
| 3,926,465 | A | 12/1975 | Hoagland et al. | |
| 3,982,781 | A * | 9/1976 | Tucker et al. | 294/19.2 |
| 4,184,707 | A | 1/1980 | Nelson et al. | |
| 4,252,490 | A * | 2/1981 | Keller | 414/434 |
| 4,412,697 | A | 11/1983 | Verde | |
| 4,460,188 | A * | 7/1984 | Maloof | 280/30 |
| 4,596,413 | A * | 6/1986 | La Porte | 294/99.1 |
| 4,811,980 | A | 3/1989 | Ferrari et al. | |
| 5,301,991 | A | 4/1994 | Chen et al. | |
| 5,464,262 | A * | 11/1995 | Madrazo | 294/19.2 |
| 5,951,075 | A | 9/1999 | Green | |
| 6,142,544 | A | 11/2000 | Benzoni et al. | |
| 6,302,460 | B1 | 10/2001 | Carr | |
| 6,340,188 | B1 * | 1/2002 | Cuti | 294/19.2 |
| 6,412,839 | B1 | 7/2002 | Tran | |
| 6,422,621 | B1 | 7/2002 | Tandlich | |

(Continued)

FOREIGN PATENT DOCUMENTS

BE 1009774 A6 8/1997

(Continued)

*Primary Examiner* — Dean Kramer
(74) *Attorney, Agent, or Firm* — Mathew L. Grell; Balser & Grell IP Law; Thomas R. Williamson, III

(57) ABSTRACT

A ball hopper comprising a frame, a divider, a plurality of elastic members and a seat, wherein the frame further comprises a lower, middle and upper portion and at least one rigid connector joining the lower, middle and upper portion, and wherein the divider separates the frame into a lower compartment and an upper compartment, and wherein the plurality of elastic members are removably secured to the lower portion of the frame. The ball hopper provides a method for collecting, distributing (while a user is standing or sitting) and transporting balls by pressing the ball hopper over an object, such that at least one of the plurality of elastic members allows the object to enter the lower compartment. Further, the ball hopper may be utilized as a seat, such that the divider forces collected balls towards the top of the ball hopper for easy removal from the lower compartment.

21 Claims, 8 Drawing Sheets

U.S. PATENT DOCUMENTS

| | | | | |
|---|---|---|---|---|
| 6,481,768 | B1 | 11/2002 | Fu | |
| 6,510,861 | B1 * | 1/2003 | Mead | 135/16 |
| 6,945,578 | B2 | 9/2005 | Hellerson | |
| 7,377,565 | B1 * | 5/2008 | Beavin | 294/19.2 |
| 7,753,420 | B2 * | 7/2010 | Beavin | 294/19.2 |
| 2004/0227365 | A1 | 11/2004 | Hellerson | |
| 2008/0122233 | A1 | 5/2008 | Beavin | |
| 2009/0020441 | A1 | 1/2009 | Beavin | |

FOREIGN PATENT DOCUMENTS

| | | | |
|---|---|---|---|
| CN | 2666503 | Y | 12/2004 |
| DE | 3144898 | A1 | 5/1983 |
| DE | 3826923 | A1 | 2/1990 |
| DE | 4323412 | A1 | 1/1994 |
| FR | 2819421 | A1 | 7/2002 |
| FR | 2838354 | A1 | 10/2003 |
| GB | 469482 | | 7/1937 |
| JP | 2005-152568 | | 6/2005 |

* cited by examiner

BALL HOPPER AND METHOD OF USE THEREOF

CROSS-REFERENCE TO RELATED APPLICATIONS

The present application incorporates by reference issued U.S. Pat. No. 7,377,565 B1, entitled "BALL COLLECTING APPARATUS AND METHOD OF USE THEREOF", and continuation-in-part application Ser. No. 12/108,211, entitled "COLLECTING APPARATUS WITH SEAT", filed on Apr. 23, 2008 now U.S. Pat. No. 7,753,420.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The preferred embodiment relates generally to a ball hopper and method of use thereof, and more specifically to a ball hopper comprising a frame, a divider, a plurality of elastic members and a seat, wherein the divider separates the frame into a lower compartment and an upper compartment, and wherein the divider forces collected balls towards a first end of the ball hopper for easy removal from the lower compartment.

2. Description of Related Art

There are various types of ball collectors or ball hoppers in existence. One such discloses a device for picking up spherical material utilizing several elastic bodies stretched on a frame body section to form an opening a little smaller than the outline of the spherical material, such as a ball, so that when pressed against the elastic bodies, the spherical material expands the elastic bodies to loosely allow passage of the spherical material through the opening into the frame body. However, this device is limited in the size of spherical objects it is able to retrieve due to the limited natural expansion of the elastic bodies and the lack of readily stretchable adjustable elastic members. Accordingly, it would not be suitable for picking up both ping pong balls and basketballs.

Another device discloses a frame for picking up table tennis balls with a grid of parallel elastic cords stretched across the frame which is fitted with a handle; however, the elastic cords are not readily adjustable and, thus, the device cannot truly accommodate substantially different size balls.

Yet another device discloses an apparatus to assist in retrieving balls and storing balls, such as tennis balls. The apparatus comprises a bottom frame through which a ball may pass upwardly when the bottom frame is positioned over the ball and pressed firmly to the ground, wherein the frame prevents the ball passing downwardly and out of the frame. The ball is retained by a rail, wherein the rail moves through springs attached to the frame; however, the device lacks a readily adjustable member to accommodate substantially different size balls.

Still another device discloses an apparatus for picking up balls, especially tennis balls, with a ball collection basket which has a ball inlet device in its base. The ball inlet device possesses longitudinal rods extending between two opposing lateral walls of the ball collection basket and arranged at least approximately parallel to each other and at a distance from each other and/or from the lateral walls lying at least approximately parallel thereto, this distance being slightly less than the diameter of a ball to be received. Collection or release frames, which are pivotable about a horizontal axis, are attached to the ball collection basket. The longitudinal parts are resilient; however, the device lacks readily adjustable longitudinal rods to accommodate substantially different size balls.

Another device discloses a device for retrieving table tennis or golf balls which comprises a frame with rectangular, polygonal or circular ends, between which are stretched elastic cords; however, the device lacks readily adjustable elastic cords to accommodate substantially different size balls.

Yet another device discloses a ball collector for picking up balls of different diameters. Springs or some other elastic material are stretched between two discs, as near as possible to the outside edge in such a fashion that the elastic material runs parallel to each other but are not horizontal to the ground, instead running from one disc to the other at a given angle. Additionally, a bracket with a long handle is fixed above the whole assembly to the outsides of the discs, which also function as wheels, so that the whole thing can be pushed along. When the device rolls over a ball, the springs or similar will move apart somewhat as they are pushed up and will cause the ball to end up in the reservoir on the inside. However, the device lacks readily adjustable springs or some other elastic material to accommodate substantially different size balls.

Still another device discloses an apparatus for picking up, transporting and storing balls which comprises two opposing planes separated by tension elements which when said tension elements are forced over a solid, hollow or pressurized sphere, the sphere simultaneously stretches the tension elements and/or compresses the sphere sufficiently to permit the sphere entry between the planes. Once the sphere is between the planes it is kept in place by the forces created by the stretched tension trying to regain their original unstretched configuration and the pinched sphere trying to regain its original configuration by trying to expand out.

Another device discloses a ball retrieval and storage device for retrieving balls of at least two different sizes comprising a wheeled container with rotatably attached handled. The container is rollingly supported by two wheels on an axle, and includes a removable rack which, when in place, covers the container to ensure the contents remain within the container. When the removable rack is placed beneath the container, the entire device is elevated to prevent needless bending and stooping by the user. The device further comprises a retrieval opening which includes a fixed member and a movable member to provide variable spacing between the fixed member and the movable member depending on the size ball to be retrieved. The device is placed near a ball to be retrieved, tilted backward onto its wheels, rolled forward such that the ball is beneath the opening, then returned to its upright position in order to capture a ball. The angular movement of the movable member in a direction generally upwardly and away from the fixed member allows for differing sized balls to be retrieved and stored. A resilient member retracts the movable member back to its original position following capturing of a ball. While such a device allows a user to pick up different size balls, it fails to also be utilized as a seat while a user is distributing balls Yet another device discloses a container for the delivery, transportation, dispensing and collection of plastic balls, which container is substantially characterized by the removal of the base, except for an inward-facing flanged edge and the arrangement of longitudinally-orientated, spaced, and calibrated sprung steel bars. The balls are pushed in through the free gaps between the bars and their emergence at the bottom is blocked. Moreover, folding handles are provided which are effective either upwards as a carrying facility or collection position or downwards in the folded-down position as supporting feet. However, the device lacks the ability to be utilized as a seat for a user during resting periods.

Still another device discloses a ball retrieving and storage device which includes a container having an elongated handle extending above it, and one or more movable gate members in the bottom of the container. Balls are retrieved from the ground by placing the bottom of the container over the balls and exerting a downward force on the handle to force the balls up against the bottom of the movable gate member which opens the gate and provides an enlarged opening in the bottom of the container for allowing each ball to pass into the container. Continued downward movement causes the moving gate member to engage stop bars on opposite sides of the container for limiting further vertical movement of the gate sufficiently to allow the equator of each ball to pass through the enlarged opening and then allow the gate to automatically drop to a closed position to retain balls in the container. A cylindrical-shaped cage also is disclosed which provides a rotary type ball retriever adapted to be rolled on the ground to engage balls which automatically open gate members spaced around the outer circumference of the cage. However, such a device requires a user to retrieve balls from the bottom of the ball collecting device, thereby causing the user to repetitively bend over and stress his/her back when obtaining a ball.

Another device discloses a ball retrieving and storage cart which generally comprises a wheeled carriage that rollingly supports a basket in a ball retrieving position. In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member and is biased to the normal position but is sideways deflectable such that a ball on the ground entering the aperture sideways deflects the deflectable member sufficiently for the ball to pass into the basket. The wheels may define a rolling plane. The carriage includes a vertical frame member terminating in a push handle and the vertical frame member includes brackets for attaching a moveable basket at a serving position that is higher than the ball retrieving position. However, such a device cannot also be utilized as a seat while a user is distributing balls.

Yet another device discloses a ball retrieval and storage device which includes a container having a hollow interior for storing a substantial number of tennis balls. At least a portion of the container bottom is formed by one or more movable rod members which are movable to allow the balls to enter through the bottom of the container. A user can retrieve a ball lying on the ground by forcing the bottom of the container down over the top of the ball. The ball engages the movable rod member and moves it slightly upwardly which allows the ball to enter the container as the container is progressively forced down over the top of the ball compressing the ball. The movable rod members are formed of a material having an elastic memory such that for use over time, the movable rod members will not permanently deform so as to decrease the efficacy of the ball retrieval and storage device. However, a user must retrieve balls from the bottom of the device, thereby causing the user to repetitively bend over.

Still another device discloses a ball retrieving and storage device including a storage container having a pair of handles hingedly fixed thereto which may be folded to a downwardly extending position supporting the container on a playing surface. The retrieving device includes a plurality of parallel rods extending across the bottom of the container. The rods are spaced apart from one another a distance greater than the diameter of the balls to be retrieved and being slightly resilient in a direction perpendicular thereto. Each of the rods has journaled thereon a hollow, cylindrical tubular roller to provide for a rotating movement, wherein the distance between inside surfaces of adjacent parallel rollers is slightly less than the diameter of a used tennis ball. The transverse resilience of the rods and the rotating motion of the rollers permit a ball to be retrieved by forcing the bottom of the container down over the ball. When folded upwardly the handles of the container enable an operator to both carry and retrieve balls from a playing surface without bending or stooping. When a substantial number of balls are held within the container, the handles may be folded into a downwardly extending position to support the container at a convenient height for the removal of balls. While such a device collect balls, it fails to be utilized as a seat for the user.

Another device discloses a ball-picking device which is utilized to pick up a ball on a ground surface, and includes a basket frame unit which confines a ball receiving space and which has a ground contacting side formed with a plurality of ball-extension gaps that are in spatial communication with the ball receiving space. Each of the ball-extension gaps is confined by a pair of deformable, yet not elastic, rod units, and is slightly narrower than a diameter of the ball such that when the ground contacting side of the basket frame unit is moved toward the ground surface to register the ball with one of the ball-extension gaps, the deformable rod units that define a respective ball-extension gap will be pushed apart and will be deformed by the ball so as to enlarge the respective ball-extension gap and permit extension of the ball into the ball receiving space. However, the device lacks readily adjustable deformable rod units to accommodate substantially different size balls.

Yet another device discloses a sports ball retrieval and storage device which includes a receptacle, a pair of support members and a lid. The receptacle is in the form of a molded one-piece body made of substantially rigid material and having a plurality of side walls and a bottom grate integrally connected together so as to define an open top and an interior chamber of the receptacle. The side walls and bottom grate are formed of respective upper and lower annular perimeter members and laterally spaced-apart elongated members extending between and integrally connected at opposite ends with opposite portions of the upper and lower annular perimeter members. The side walls converge toward one another from the open top to the bottom grate of the receptacle and thereby provide the molded one-piece body of the receptacle with a tapered configuration permitting receptacles of multiple devices to nest with one another. The elongated members of the bottom grate are spaced apart at a distance slightly less than the diameter of a tennis ball so as to define at least one opening therebetween through which a compressed tennis ball can be forced into the interior chamber. The support members are pivotally mounted to the receptacle and convertible relative thereto between stand and handle positions. The lid is mounted to the receptacle for opening and closing the open top thereof. However, such a device requires a user to obtain balls from the bottom of the device, thereby causing stress to a user's back.

Still another device discloses a tennis ball collector with drum cage, wherein the drum's peripheral surface has axially-parallel bars between its end flanges which are in the form of discs or tires. The U-shaped handle has sides each of which has an angled section which, together with the middle of the U-shaped handle, forms a U-shaped stand. Wheels are attached to the angled parts which have a profiled grip surface. However, the device lacks readily axially-parallel bars to accommodate substantially different size balls.

Another device discloses a collapsible ball retriever and storage unit which is in the form of a receptacle composed of a plurality of side grills pivotally hinged one to the next, and a top gate and a bottom grate being pivotally hinged to respective ones of the side grills. The side grills are pivotable relative to one another to convert them between erected and collapsed positions, whereas the top gate and bottom grate are pivotable relative to the side grills to convert the top gate and bottom grate between closed and retracted opened positions. The gate and grate are latchable to others of the side grills disposed opposite to the ones thereof to which the gate and grate are respectively hinged. The bottom grate is adapted to rigidly retain the side grills in their erected position when the bottom grate is disposed in the closed position. Further, the bottom grate has members defining ball passages therethrough which adapts the receptacle for retrieving and storing balls when the side grills are in the erected position and the bottom grate is in the closed However, the device does not provide a seat for a user to sit on while distributing balls from the device.

Yet another device discloses a tennis ball retriever includes a cylindrical collection drum having circular cylinder bases spaced from one another. The cylindrical collection drum has openings formed in a peripheral cylinder region such that balls can be pushed therethrough. The circular cylinder bases have sleeves extending along the cylinder axis. A removable handle includes two arms extending away from the cylinder axis. The arms have stub axles at their ends such that the stub axles extend along the cylinder axis and are rotatably journaled in the sleeves. The removable handle is resiliently deformable for moving the stub axles away from the sleeves so that the cylindrical collection drum can be removed from the handle. A ball retrieving and storing system is also provided. The ball retrieving and storing system includes at least two cylindrical collection drums and a removable handle. However, such a device does not provide a user with a seat to sit on during resting periods.

Still another device discloses a tennis ball retriever and storage unit includes a ball retrieving receptacle supported by spring biased pivoting wheel assemblies for rolling movement between locations for retrieving used tennis balls and downwardly movement from a normal upper transport position overlying a tennis ball to a lower position for retrieving the tennis ball between spaced rigid bars in the base of the receptacle. However, such a device requires a user to retrieve balls from the bottom of the ball collecting device.

Yet another device teaches a ball collecting device comprising a plurality of elastic members secured to a lower portion of a frame. The elastic members allow the ball collecting apparatus to pick up spherical objects of different sizes. The elastic members separate and allow the ball to enter the ball collecting apparatus, and then the elastic members retract to their original position to keep the balls from falling back out. However, such a device does not force balls toward the top of the ball device for easy removal.

Nonetheless, due to the constraints of current devices for picking up balls, most devices either fail to pick up different types and shapes of spherical objects, fail to also be utilized as a seat during resting periods or while a user is distributing balls, or require a user to retrieve balls from the bottom of the ball collecting device, thereby causing the user to repetitively bend over and stress his/her back when obtaining a ball when the user is in either in a sitting or standing position.

Therefore, it is readily apparent that there is a need for an apparatus that allows a user to pick up, transport, and store balls of different diameter, while also allowing a user to distribute balls from the apparatus without requiring the user to retrieve collected balls from the bottom of the apparatus.

BRIEF SUMMARY OF THE INVENTION

Briefly described, in a preferred embodiment, the present invention overcomes the above-mentioned disadvantages and meets the recognized need for such an apparatus by providing a ball hopper comprising a frame having a divider, a plurality of elastic members and a seat, wherein the frame further comprises a lower portion, a middle portion, an upper portion and at least one rigid connector joining the lower portion, the middle portion and the upper portion, and wherein the divider slopes from the upper portion to the middle portion of the frame and separates the frame into a lower compartment and an upper compartment, and wherein the plurality of elastic members are removably secured to the lower potion of the frame.

According to its major aspects and broadly stated, the present invention in its preferred form is a ball hopper comprising a frame, a divider, a plurality of elastic members and a seat. The frame comprises a lower portion, a middle portion, an upper portion and at least one rigid connector joining the lower portion, the middle portion and the upper portion. The divider slopes from the upper portion to the middle portion of the frame and separates the frame into a lower compartment and an upper compartment and the plurality of elastic members are disposed on the lower portion of the frame. Additionally, the lower portion of the frame comprises at least one lower hook and the upper portion of the frame comprises at least one upper hook. The frame of the ball hopper further comprises a first end having a rigid panel that is utilized as a seat for a user to sit upon while distributing balls or during resting periods.

Additionally, the plurality of elastic members is stretchably adjustable in length and each member comprises a first end and a second end. The first end and the second end of each of the plurality of elastic members secure around the lower portion of the frame, thereby forming a loop, and are secured to the lower portion of the frame, via, for exemplary purposes only, a fastener. Further, the second end of each of the plurality of elastic members selectively comprises lower retention spheres at the end thereof, wherein the lower retention spheres attach to the lower hook. The lower retention spheres selectively un-hooks from the lower hook on the lower portion of the frame to access the lower compartment.

The ball hopper further comprises at least one upper elastic member disposed on the upper portion of the frame. The upper elastic member is strechably adjustable in length and comprises a first end and a second end. The first end and the second end secure to points disposed on the upper portion of the frame, and the second end comprises a top retention sphere at the end thereof. The top retention sphere selectively attaches to and un-hooks from the upper hook on the upper portion of the frame to access the upper compartment.

Additionally, the ball hopper comprises a first handle and a second handle disposed on the frame. The first handle and the second handle adjust to selected angles including an upright position, a collapsed position and an inwardly leaning position. The second handle is wider than the first handle, such that when the handles are in the collapsed position, the first handle fits inside the second handle.

The lower portion of the frame further comprises a plurality of feet. The plurality of feet prevents damage to the plurality of elastic members disposed on the lower portion of the frame when the ball hopper is in use. Additionally, the divider comprises a first end and a second end. The first end of the divider is disposed on one of the rigid connectors on the upper portion of the frame. The second end of the divider is disposed on the middle portion of the frame.

In an alternate embodiment, the divider is adjustable via a mechanism. The mechanism selectively adjusts the position of the divider via, for exemplary purposes only, stoppers. The adjustment of the divider allows a user to selectively alter the size of the lower compartment and the upper compartment. The divider acts as a ramp to force balls toward the top of the ball section for easy removal.

The preferred embodiment further comprises a method of collecting and distributing objects comprising the steps of obtaining a ball hopper, selectively unhooking at least one upper elastic member from the upper portion of the frame, storing personal items in the upper compartment, selectively re-hooking at least one upper elastic member to the upper portion of the frame (thereby securing personal items in the upper compartment), securing the handles in an inwardly leaning position and pressing the frame over an object, thereby causing forces to be exerted on at least one elastic member, such that at least one elastic member moves open to a width which allows the object into the lower compartment of the frame.

The method of collecting and distributing objects further comprises the steps of rotating the handles into an upright position and away from the frame, such that the handles support the ball hopper on a surface, unhooking the plurality of elastic members from the lower portion of the frame, removing objects from the lower compartment of the frame and re-hooking the second ends of the plurality of elastic members to the lower portion of the frame.

The method further comprises the steps of rotating the handles toward the frame into the collapsed position, selectively rotating the frame, such that the seat is parallel to the ground, sitting on the seat, un-hooking the plurality of elastic members from the lower portion of the frame, removing objects from the lower compartment of the frame and re-hooking the plurality of elastic members to the lower portion of the frame.

In an alternate embodiment, the method of collecting and distributing objects comprises the steps of obtaining a ball hopper with handle plates having wheels and handles having hinges, rotating one of the handles into the collapsed position, rotating the other handle into the upright position and about its hinges and pulling the ball hopper via one of the handles to another location via the wheels.

Additionally, the preferred embodiment is a ball collecting apparatus comprising a frame. The frame comprises a plurality of elastic members, handles, a divider and a seat. The handles are adjustable and the divider separates the frame into an upper compartment and a lower compartment.

More specifically, the preferred embodiment is a ball hopper comprising a frame. The frame comprises a lower portion, a middle portion, an upper portion, a first end, a second end, a divider, a plurality of connectors, a first handle and a second handle. The divider slopes from the upper portion to the middle portion of the frame. The plurality of connectors comprises front rods, top rods and back rods and connects the lower portion, the middle portion and the upper portion of the frame. The lower portion comprises lower hooks and the upper portion comprises an upper hook. The frame further comprises a plurality of elastic members. Each of the plurality of elastic members has first ends and second ends. The first ends and the second ends comprise loops and the loops wrap around and fastens to points along the lower portion of the frame. The second ends of the plurality of elastic members selectively comprise lower retention spheres at the ends thereof, and the lower retention spheres hook and secure to the lower hooks on the lower portion.

Additionally, the upper portion comprises handle plates. The handle plates comprise a first notch, a second notch and a third notch. The first notch, the second notch and the third notch are dimensioned to receive and secure the first handle and the second handle. The first handle and the second handle are generally round in shape, and the second handle is wider than the first handle. The first handle and the second handle are selectively positioned into one of three positions according to whether the first handle or the second handle is secured into the first notch, the second notch or the third notch on the handle plates. The first handle or the second handle is positioned upright when the first handle or the second handle is secured in the first notch. Additionally, the first handle or the second handle is positioned at an inwardly leaning angle when the first handle or the second handle is secured in the second notch. Lastly, the first handle or the second handle is in the collapsed position when the first handle or the second handle is secured in the third notch, such that the first handle fits inside the second handle.

Additionally, the frame further comprises a first member. The first member comprises a top elastic portion, a front elastic portion, a bottom elastic portion and a back connector. The back connector joins the top portion, the middle portion and the bottom portion. The top elastic portion of the first member is removable and comprises a first end and a second end. The first end comprises a top retention sphere at the end thereof, and the top retention sphere secures to a hook disposed on the top portion. The second end of the top elastic portion comprises a loop. The loop fastens around and secures via, for exemplary purposes only, a fastener to a point on the top portion. The front elastic portion of the first member comprises a top end and a bottom end. The top end comprises a loop, and the loop fastens around and secures to a point via a fastener on the top portion. The bottom end comprises a loop, and the loop fastens around and secures to a point on the bottom portion. The bottom elastic portion of the first member comprises a first end and a second end. The first end comprises a loop, and the loop fastens around a point on the bottom portion. The second end comprises a loop, and the loop fastens around a point on the bottom portion. Further, the bottom portion of the frame may further comprise feet. The feet prevent wear and tear on the plurality of elastic members when the ball hopper is in use. Lastly, the second end of the frame comprises connectors. The connectors extend between the lower portion, the middle portion and the upper portion of the frame. It will be recognized by those skilled in the art that the feet may be located anywhere on the frame, including the upper portion.

Further, the divider of the ball hopper comprises bars. The bars comprise first ends and second ends, and the first ends are disposed proximate the top rods of the plurality of connectors. The second ends are disposed proximate the middle portion along the back side of the frame. The divider separates the ball hopper into a storage section and a ball section. The storage section is utilized to store personal items of a user utilizing the ball hopper. The ball section is utilized to store collected baseballs. The storage section is accessed by unhooking the top retention sphere of the top elastic portion from the upper hook disposed on the upper portion and placing personal items into the storage section. The personal items are subsequently stored and secured in the storage section by re-hooking the top retention sphere to the upper hook. Additionally, the first end of the frame comprises a rigid plate. The rigid plate is disposed proximate the lower portion, the middle portion and the upper portion of the frame. The rigid plate is selectively utilized as a chair for a user to sit on during resting periods.

In use, the first handle and the second handle are secured into the second notch on the handle plates, such that the first handle and the second handle are positioned angularly toward each other. A user's hand grasps both the first handle and the second handle and places the lower portion of the ball hopper over balls and presses down. The balls moves through the plurality of elastic members and into the ball section, and the balls are contained in the ball section for transport or storage. The plurality of elastic members may run horizontally, vertically, diagonally or in any combination. Additionally, placement of the points on the lower portion may vary and thus different placement of the plurality of elastic members is possible, although the points are spaced to most efficiently accommodate spherical objects of different shapes. Also, the ball hopper may collect a variety of ball shapes other than baseballs, such as, for exemplary purposes only, golf balls, ping pong balls, and the like.

The ball hopper is also utilized to distribute balls. The first handle and the second handle are secured in the first notch on the handle plates, such that the first handle and the second handle extend vertically downward to support the ball hopper on the ground. A user may selectively remove balls from the ball hopper by unhooking the lower retention spheres on the plurality of elastic members from the lower hooks of the lower portion, and retrieve balls from the ball section, wherein the divider forces balls towards the top of the ball section for easy removal when the ball hopper is in the standing position. When a user is done removing the balls, the ball section is re-secured by re-hooking the lower retention spheres on the plurality of elastic members to the lower hooks of the lower portion.

Further, the rigid plate of the ball hopper is utilized as a seat for a user to sit on during resting periods or while the user is distributing balls. To utilize the ball hopper as a seat, the first handle and the second handle are either adjusted in the collapsed position and secured in the third notch on the handle plates, such that the first handle fits inside the second handle, and the second end of the ball hopper contacts the ground. Alternatively, the ball hopper may be utilized as a seat when the first handle and the second handle are in the inwardly-leaning position, wherein the first and second handle is secured in the second notch on the handle plates. Once seated on the rigid plate, the user may distribute balls from the ball section. The opening is on the right or left side for easy removal of balls. The divider forces the balls toward the first end of the ball hopper, thereby reducing the need for the user to reach toward the second end of the ball hopper to retrieve balls. To obtain balls, the user unhooks at least one of the lower retention spheres on the plurality of elastic members from the lower hooks of the lower portion, such that the at least one of the lower retention spheres on the plurality of elastic members is positioned closest the top side of the ball hopper, thereby accessing the balls from the top of the ball section. A user may selectively continue to unhook additional lower retention spheres on the plurality of elastic members, positioned closer to the bottom side of the ball hopper, to access additional balls at the bottom of the ball section. When a user is done removing the balls, the ball section is closed by re-hooking the lower retention spheres on the plurality of elastic members to the lower hooks on the lower portion.

In an alternate embodiment, the ball hopper comprises handle plates. The handle plates are disposed proximate the first end and second end of the frame. The handle plates comprise wheels for easily transporting the ball hopper. Further, the handles comprise hinges. The hinges allow the first handle to be rotated toward the first end of the frame and the second handle to be rotated toward the second end of the frame. In use, for exemplary purposes, the second handle is in the collapsed position and is secured into the third notch on the lower handle plates. The first handle is secured in the first notch of the handle plates. The first handle is further rotated toward the first end of the frame via the hinges. The user subsequently grasps the first handle and rolls the ball hopper on the wheels and transports baseballs and personal items to another location. It will be recognized by those skilled in the art that the opposite actions may be followed through on each handle to achieve the same net effect of transporting the ball hopper to a another location.

In another alternate embodiment, the ball hopper comprises an adjustable divider, horizontal rods and stoppers. The adjustable divider comprises first ends and second ends. The first ends and second ends of the adjustable divider comprise stoppers at the ends thereof. To shift the adjustable divider, the first ends of the adjustable divider shift horizontally along the horizontal rods and the second ends of the adjustable divider shift vertically along the connectors disposed on the second end of the frame. The stoppers secure the first ends of the adjustable divider on the horizontal rods and also the second ends of the adjustable divider on the connectors, thereby allowing the user to adjust the area of the storage section and the ball section of the ball hopper.

Accordingly, a feature and advantage of the present invention is its ability to allow for the quick and easy adjustment of elastic members to accommodate different size spherical objects.

Still another feature and advantage of the present invention is its ability to be utilized as a chair for a user to sit on during resting periods or while the user is distributing balls.

Yet another feature and advantage of the present invention is its ability to ease the burdens and physical stresses on a user by minimizing the amount of bending over movements required to pick up balls.

Still another feature and advantage of the present invention is its ability to adjust the divider to either increase or decrease the ball storage area.

Yet still another feature and advantage of the present invention is its ability to minimize the amount of protruding objects and exposed portions of the apparatus that may potentially catch on unattended objects.

A further feature and advantage of the present invention is its ability to provide adjustable storage area for personal items or equipment.

Still another feature and advantage of the present invention is its ability to provide feet to slightly raise the apparatus above the ground, thereby reducing wear and tear on the elastic members.

Another feature and advantage of the present invention is its wheels that aid in transportation of the apparatus.

Still yet another feature and advantage of the present invention is to provide an apparatus with handles that may be locked into different positions for a variety of methods of use.

Yet another feature and advantage of the present invention is to provide an apparatus that allows a user to remove balls from the ball section while either standing or in the sitting position.

Another feature and advantage of the present invention is its ability to provide an adjustable opening to retrieve balls from the ball storage area.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1A-7, specific terminology is employed for the sake of clarity. The invention, however, is not intended to be limited to the specific terminology so selected, and it is to be understood that each specific element includes all technical equivalents that operate in a similar manner to accomplish similar functions.

Figure 1A:
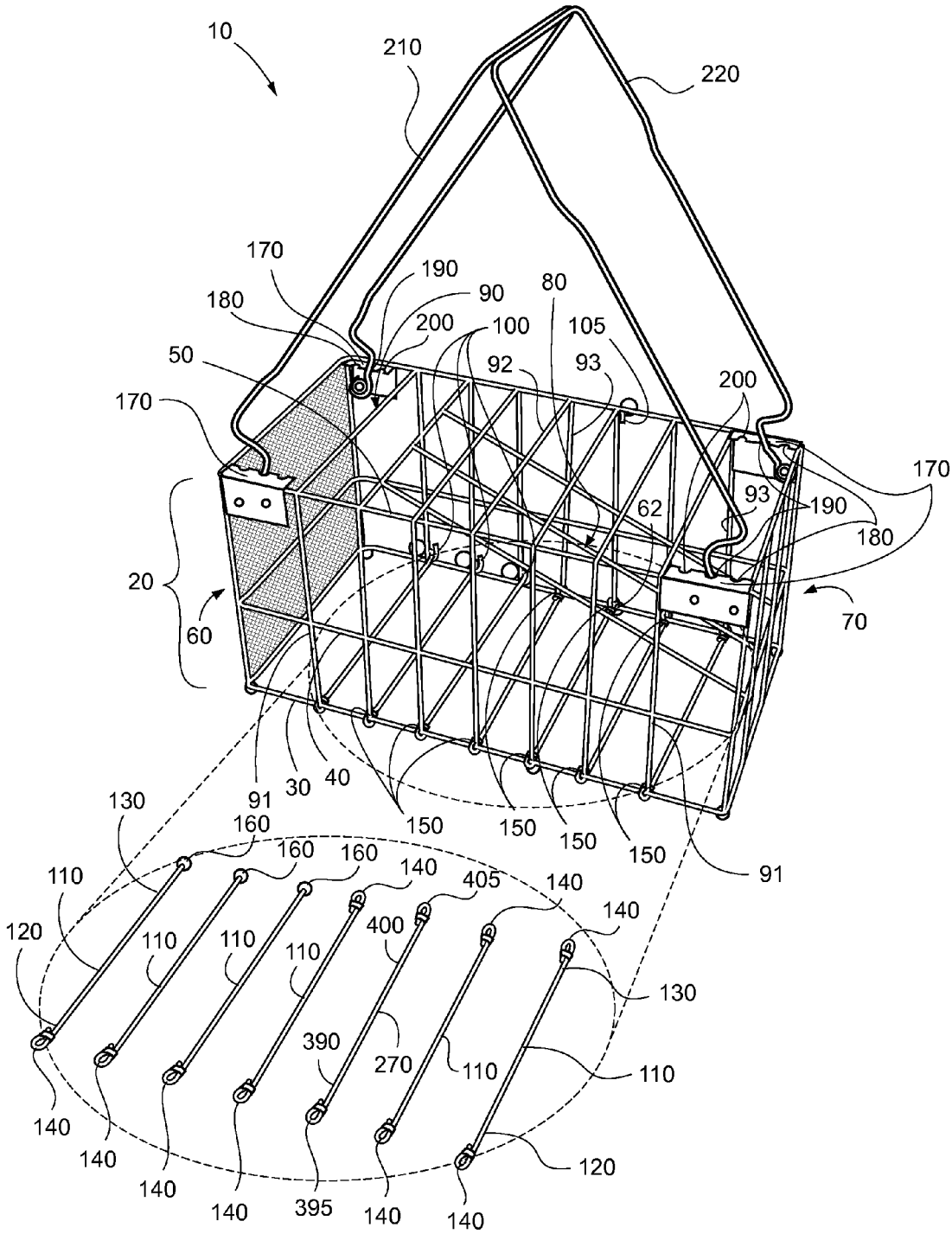
FIG. 1A is a front perspective view of a ball hopper according to a preferred embodiment shown with elastic members exploded out.
Figure 1B:
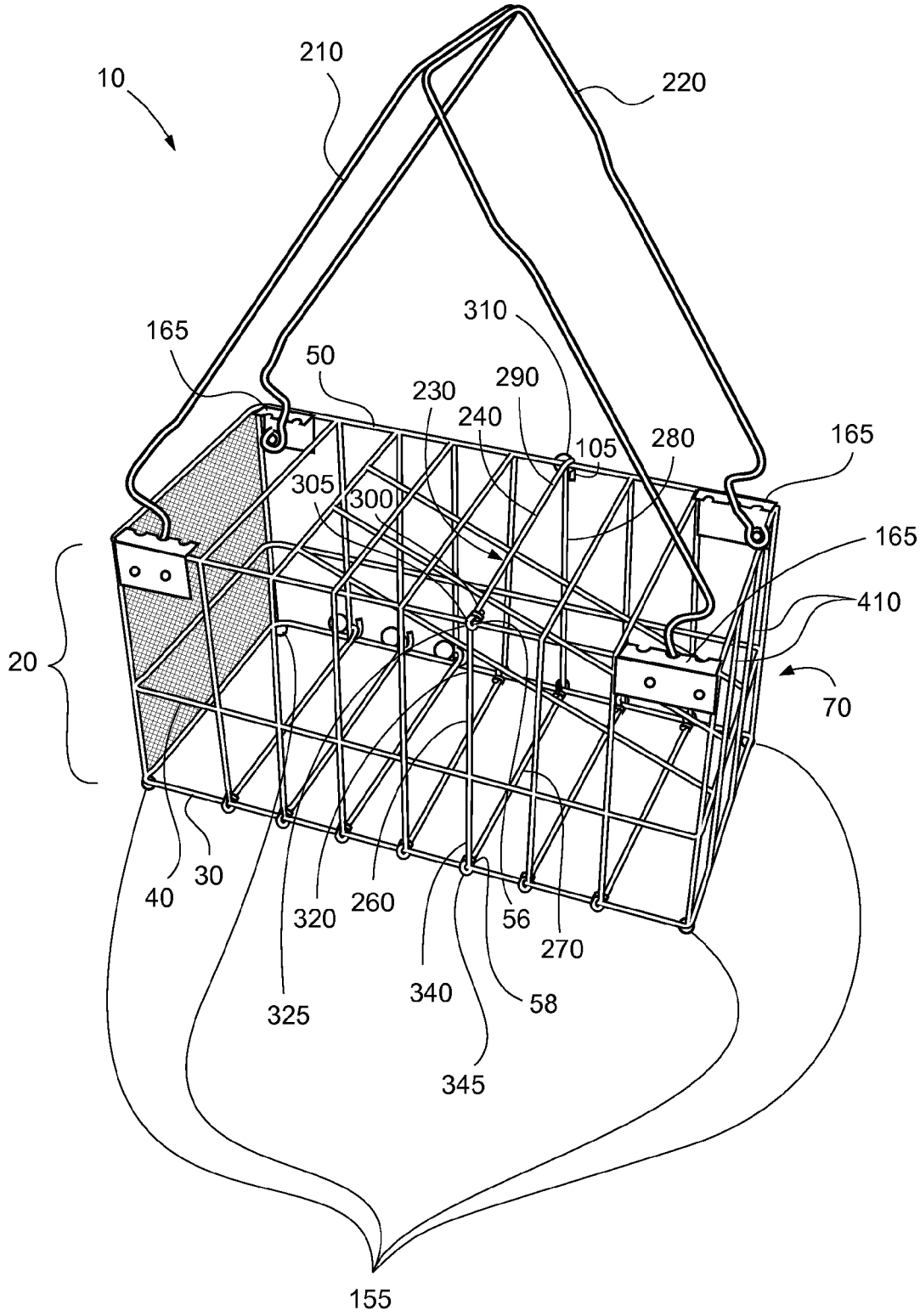
FIG. 1B is a front perspective view of a ball hopper according to a preferred embodiment with handles in the collecting and/or carrying position.

Referring now to FIGS. 1A and 1B, ball hopper 10 comprises frame 20, wherein frame 20 comprises lower portion 30, middle portion 40, upper portion 50, first end 60, second end 70, divider 80, connectors 90, first handle 210 and second handle 220. Connectors 90 comprise front rods 91, top rods 92 and back rods 93, wherein a plurality of connectors 90 joins lower portion 30, middle portion 40 and upper portion 50 of frame 20, and wherein lower portion 30 comprises lower hooks 100, and wherein upper portion 50 comprises upper hook 105. Frame 20 of ball hopper 10 further comprises plurality of elastic members 110, wherein plurality of elastic members 110 comprise first ends 120 and second ends 130, and wherein some first ends 120 and some second ends 130 comprise loops 140, and wherein loops 140 wrap around and fasten to points 150 along lower portion 30 of frame 20, and wherein second ends 130 of plurality of elastic members 110 selectively comprise lower retention spheres 160 at the end thereof, and wherein lower retention spheres 160 hook and secure to lower hooks 100 of lower portion 30.

Figure 4:
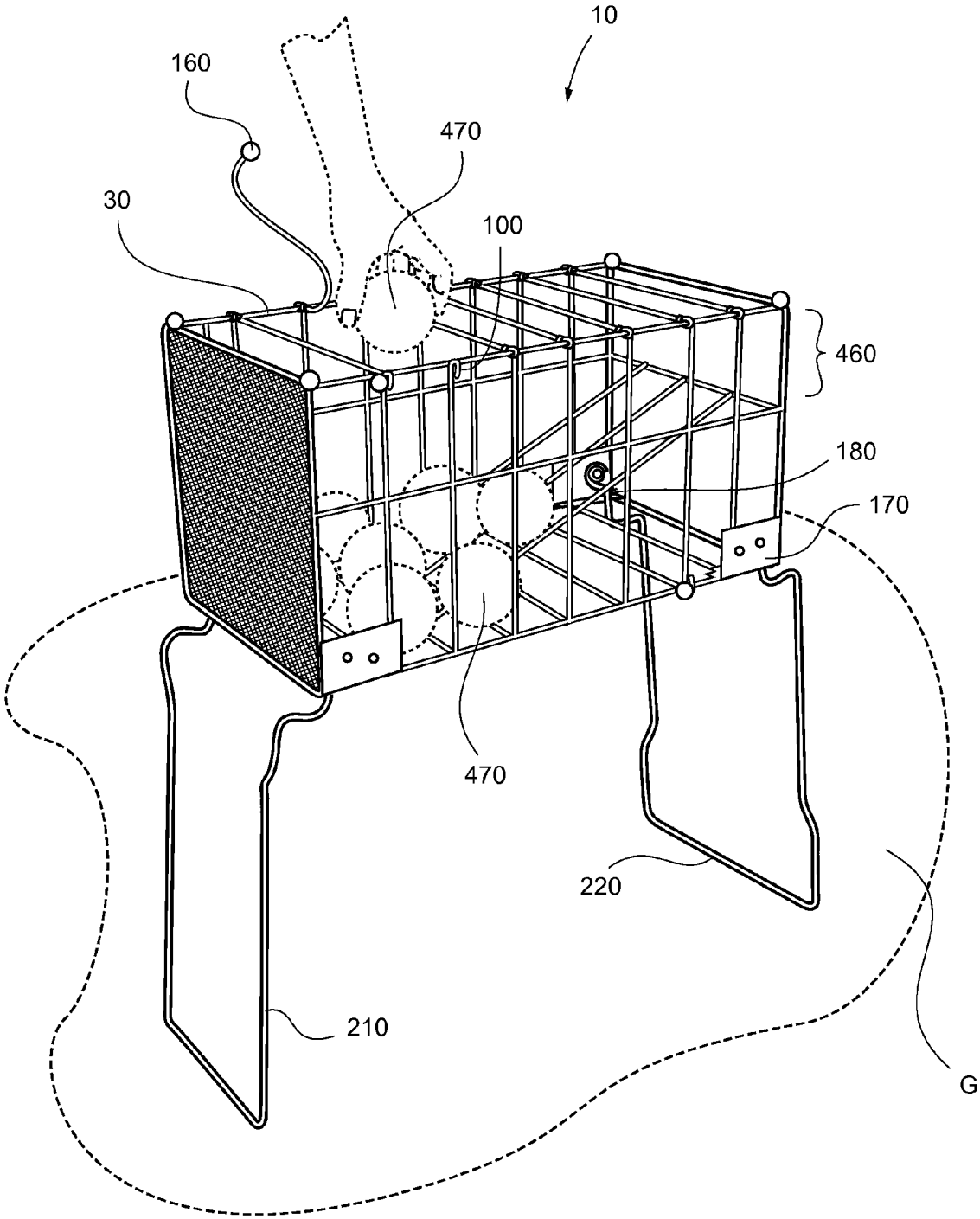
FIG. 4 is a front perspective view of a ball hopper according to a preferred embodiment, shown with handles forming a stand for facilitating distribution of balls from the ball section while a user is standing upright.
Figure 5:
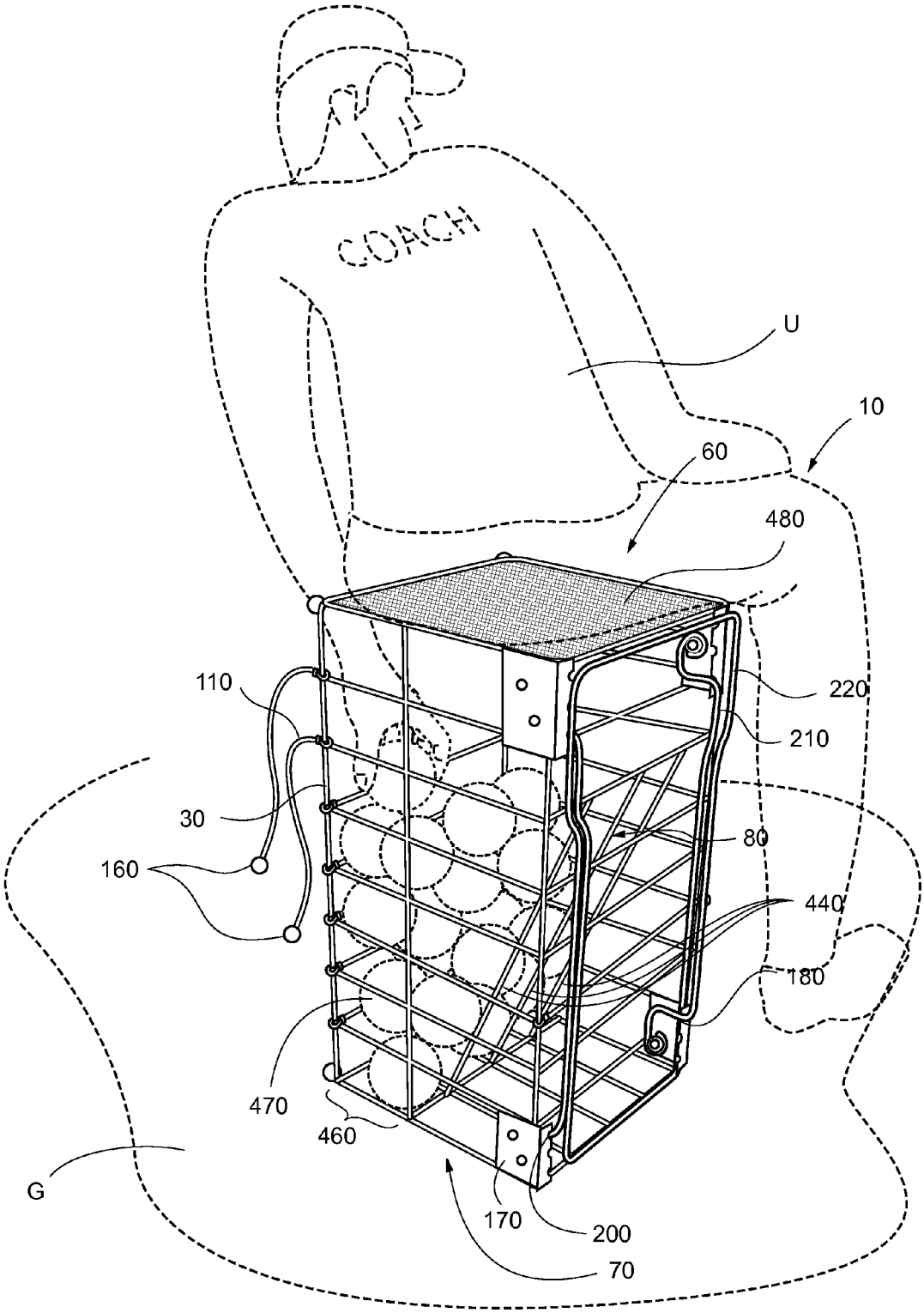
FIG. 5 is a side perspective view of a ball hopper according to a preferred embodiment, shown positioned as a seat for a user to sit upon while removing and distributing balls from the ball section.

Still referring to FIGS. 1A-1B, upper portion 50 further comprise handle plates 170, wherein handle plates 170 comprise first notch 180, second notch 190 and third notch 200, and wherein first notch 180, second notch 190 and third notch 200 are dimensioned to receive and removably-secure first handle 210 and second handle 220, and wherein first handle 210 and second handle 220 are generally round in shape, and wherein second handle 220 is wider than first handle 210. First handle 210 and second handle 220 are selectively positioned into one of three positions according to whether first handle 210 or second handle 220 is secured into first notch 180, second notch 190 or third notch 200 on handle plates 170. First handle 210 or second handle 220 is positioned upright when first handle 210 or second handle 220 is secured in first notch 180 (as best shown in FIG. 4). Additionally, first handle 210 or second handle 220 is positioned at an inwardly leaning angle when first handle 210 or second handle 220 is secured in second notch 190 (best shown in FIG. 3). Lastly, first handle 210 or second handle 220 is in the collapsed position when first handle 210 or second handle 220 is secured in third notch 200 (as shown in FIG. 5), wherein first handle 210 fits inside second handle 220 when both first handle 210 and second handle 220 are in the collapsed position simultaneously.

Referring now more specifically to FIG. 1B, frame 20 of ball hopper 10 further comprises first member 230, wherein first member 230 comprises top elastic portion 240, front elastic portion 260, bottom elastic portion 270 and back connector 280, and wherein back connector 280 joins top portion 50, middle portion 40 and bottom portion 30. Top elastic portion 240 of first member 230 is removable and comprises first end 290 and second end 300, wherein first end 290 comprises top retention sphere 310 at the end thereof, and wherein top retention sphere 310 secures to hook 105 disposed on top portion 50, and wherein second end 300 comprises loop 305, and wherein loop 305 fastens around and secures to first juncture 56 of top portion 50. Front elastic portion 260 of first member 230 comprises top end 320 and bottom end 340, wherein top end 320 comprises loop 325, and wherein loop 325 fastens around and secures to first juncture 56 on top portion 50, and wherein bottom end 340 comprise loop 345, and wherein loop 345 fastens around and secures to second juncture 58 on bottom portion 30. As best shown in FIG. 1A, bottom elastic portion 270 comprises first end 390 and second end 400, wherein first end 390 comprises loop 395, and wherein loop 395 fastens around second juncture 58 of bottom portion 30, and wherein second end 400 comprises loop 405, and wherein loop 405 fastens around point 62 of bottom portion 30. Further, bottom portion 30 of frame 20 may further comprise feet 155 (best shown in FIG. 1B), wherein feet 155 prevent wear and tear on plurality of elastic members 110 when ball hopper 10 is in use (best shown in FIG. 3). Lastly, second end 70 of frame 20 comprises connectors 410, wherein connectors 410 extend between lower portion 30, middle portion 40 and upper portion 50 of frame 20. It will be recognized by those skilled in the art that feet 155 may be located anywhere on frame 20, including upper portion 50.

Figure 2:
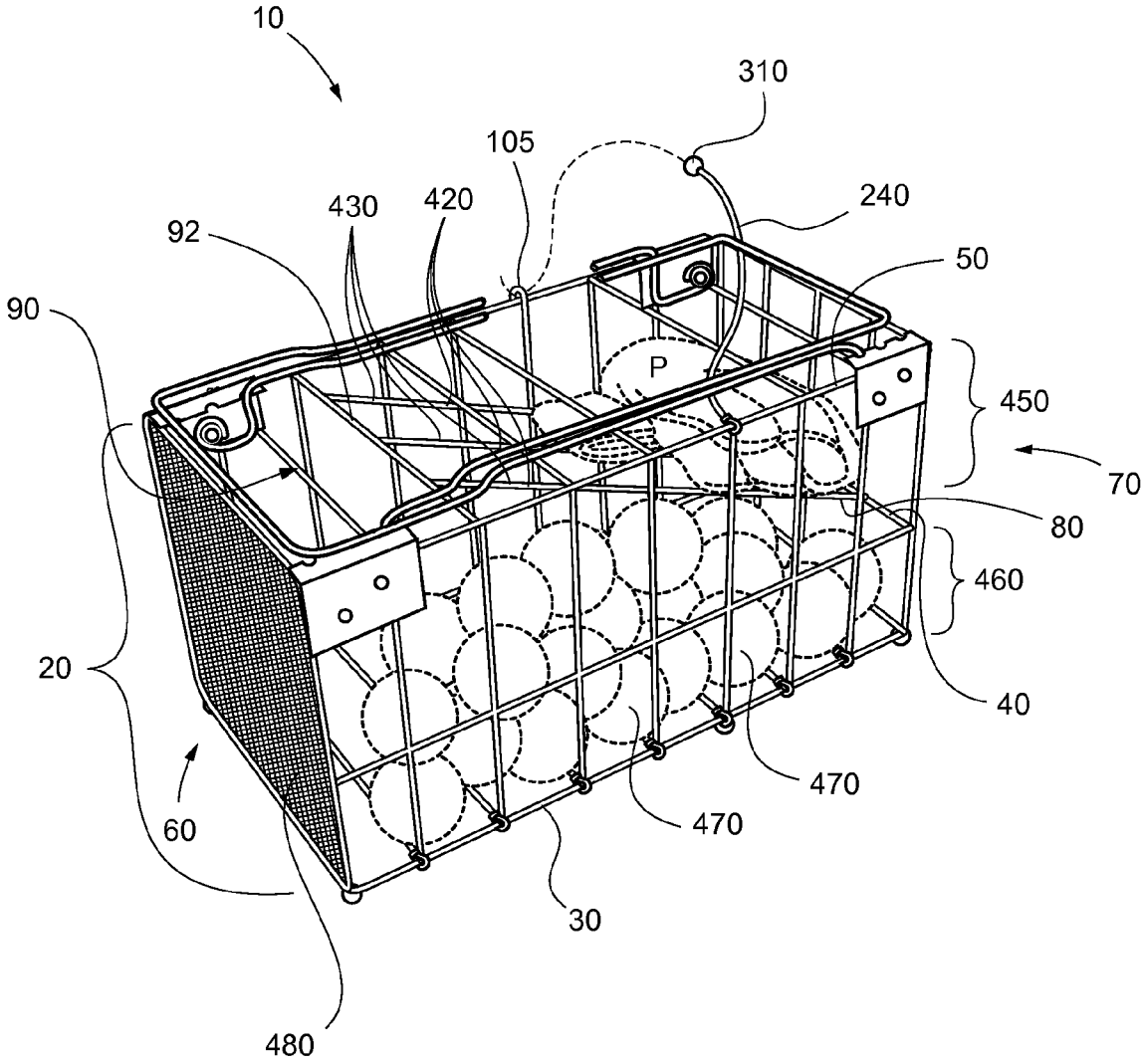
FIG. 2 is top perspective view of a ball hopper according to a preferred embodiment, shown with handles in closed position and showing access to the storage section.

Referring now to FIG. 2, divider 80 of ball hopper 10 comprises bars 420, wherein bars 420 comprise first ends 430 and second ends 440 (best shown in FIG. 5), and wherein first ends 430 are disposed proximate top rods 92 of plurality of connectors 90, and wherein second ends 440 are disposed proximate middle portion 40 along back side 70 of frame 20. Divider 80 separates ball hopper 10 into storage section 450 and ball section 460, wherein storage section 450 is utilized to store personal items P of a user utilizing ball hopper 10, and wherein ball section 460 is utilized to store collected balls 470, such as for exemplary purposes only, baseballs. Storage section 450 is accessed by unhooking top retention sphere 310 of top elastic portion 240 from upper hook 105 disposed on upper portion 50 and placing personal items into storage section 450, wherein personal items P are subsequently stored and secured in storage section 450 by re-hooking top retention sphere 310 to upper hook 105. Additionally, first end 60 of frame 20 comprises rigid plate 480, wherein rigid plate 480 is disposed proximate lower portion 30, middle portion and upper portion 50 of frame 20, and wherein rigid plate 480 is selectively utilized as a chair for a user to sit on during resting periods and while distributing balls 470 (best shown in FIG. 5).

Figure 3:
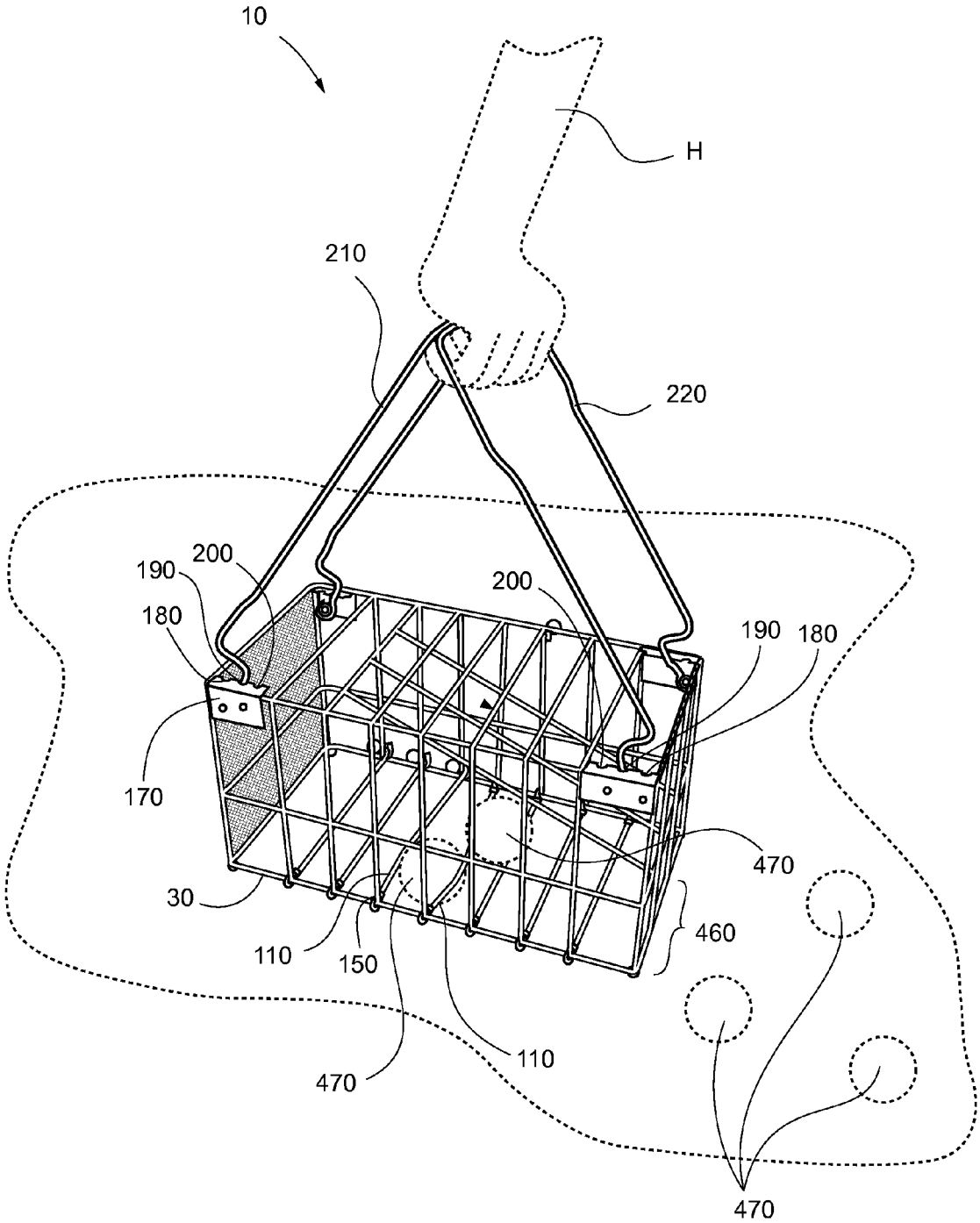
FIG. 3 is a top perspective view of a ball hopper according to a preferred embodiment, shown in use collecting balls.

Referring now to FIG. 3, in use, first handle 210 and second handle 220 are secured into second notch 190 of handle plates 170, wherein first handle 210 and second handle 220 are positioned angularly toward each other. A user's hand H grasps first handle 210 and second handle 220 and places lower portion 30 of ball hopper 10 over, for exemplary purposes only, balls 470 and presses down, wherein balls 470 moves through plurality of elastic members 110 and into ball section 460, and wherein balls 470 are contained in ball section 460 for transport and/or storage. It will be recognized by those skilled in the art that plurality of elastic members 110 may run horizontally, vertically, diagonally and/or any combination thereof. It will also be recognized by those skilled in the art that placement of points 150 on lower portion 30 and thus different placement of plurality of elastic members 110 is possible, although points 150 are spaced to most efficiently accommodate spherical objects of different shapes. It will also be recognized by those skilled in the art that ball hopper 10 may collect a variety of ball other than balls 470, such as for exemplary purposes, golf balls, ping pong balls, and the like.

Referring now to FIG. 4, ball hopper 10 is selectively utilized to distribute balls 470 when a user is standing upright, wherein first handle 210 and second handle 220 is secured in first notch 180 on handle plates 170, wherein first handle 210 and second handle 220 extend vertically downward and away from frame 20, thereby supporting ball hopper 10 on ground G. A user may selectively remove balls 470 by unhooking at least one of lower retention spheres 160 on second ends 130 of plurality of elastic members 110 from at least one of lower hooks 100 of lower portion 30, thereby retrieving balls 470 from ball section 460. When a user is done removing balls 470, ball section 460 is re-secured by re-hooking lower retention spheres 160 to lower hooks 100 of lower portion 30.

Referring now to FIG. 5, when ball hopper 10 is positioned with second end 70 proximate ground G, rigid plate 480 of ball hopper 10 may be utilized as a seat for user U to sit upon during resting periods or to distribute balls 470, wherein first handle 210 and second handle 220 is in the collapsed position and secured in third notch 200 on handle plates 170, and wherein first handle 210 fits inside second handle 220. Alternatively, ball hopper 10 may be utilized as a seat for user U to sit upon during resting periods or to distribute balls 470, wherein first handle 210 and second handle 220 are in the inwardly-leaning position and secured in second notch 190 on handle plates 170. Once seated on rigid plate 480, user U may selectively distributes balls 470 from ball section 460, wherein divider 80 pushes balls 470 toward first end 60 of ball hopper 10, thereby reducing the need for user U to reach toward second end 70 of ball hopper 10 to retrieve balls 470. To obtain balls 470, user U unhooks at least one of lower retention spheres 160 on plurality of elastic members 110 from lower hooks 100 disposed on lower portion 30, thereby accessing balls 470 from ball section 460. As the ball level lowers in ball section 460, user U may selectively continue to unhook lower retention spheres 160 on plurality of elastic members 110 from lower hooks 100 disposed on lower portion 30 to obtain more balls 470. When a user is done removing balls 470, ball section 460 is closed by re-hooking lower retention spheres 160 on plurality of elastic members 110 to lower hooks 100 disposed on lower portion 30.

Figure 6:
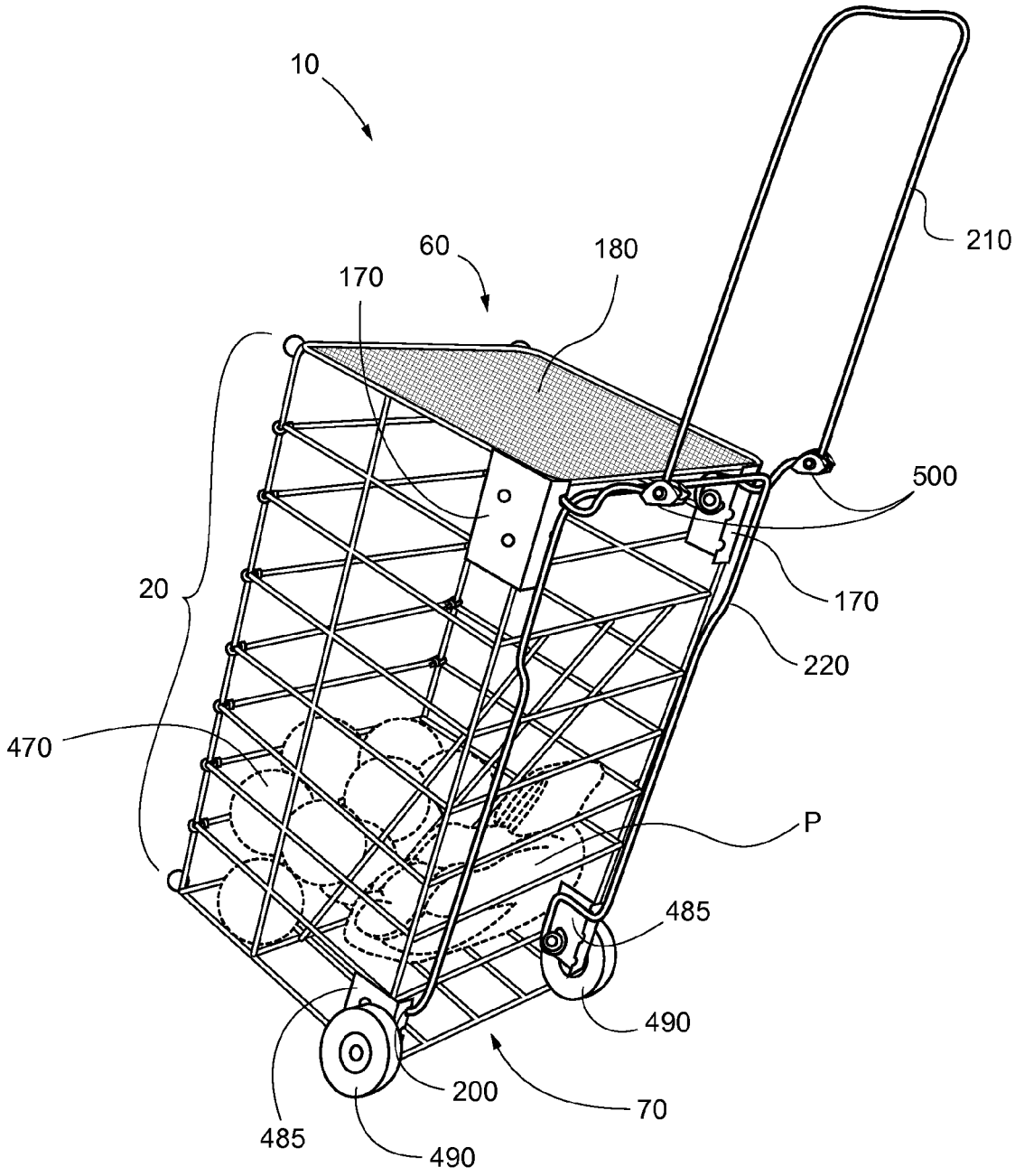
FIG. 6 is a side perspective view of an alternate embodiment of a ball hopper, shown with one handle open for transportation of balls.

Referring now more specifically to FIG. 6, illustrated therein is an alternate embodiment of ball hopper 10, wherein the alternate embodiment of FIG. 6 is substantially equivalent in form and function to that of the embodiment detailed and illustrated in FIGS. 1A-5 except as hereinafter specifically referenced. Specifically, the alternate embodiment of FIG. 6 comprises lower handle plates 485, wherein lower handle plates 485 are disposed proximate second end 70 of frame 20, and wherein lower handle plates 485 comprise wheels 490 for easily transporting ball hopper 10. Further, first handle 210 further comprises hinges 500, wherein hinges 500 allow first handle 210 to be rotated toward first end 60 of frame 20. In use, second handle 220 is in the collapsed position, wherein second handle 220 is secured into third notch 200 on lower handle plates 485, and wherein first handle 210 is secured in first notch 180 on handle plates 170, and wherein first handle 210 is further rotated toward first end 60 of frame 20 via hinges 500. User U subsequently grasps first handle 210 and rolls ball hopper 10 on wheels 490 and transport balls 470 and personal items P to another location. It will be recognized by those skilled in the art that wheels 490 may be disposed on first end 60 and that hinges 500 may be disposed on second handle 220, such that the opposite actions may be followed on each handle to achieve the same net affect of transporting ball hopper 10 to another location.

Figure 7:
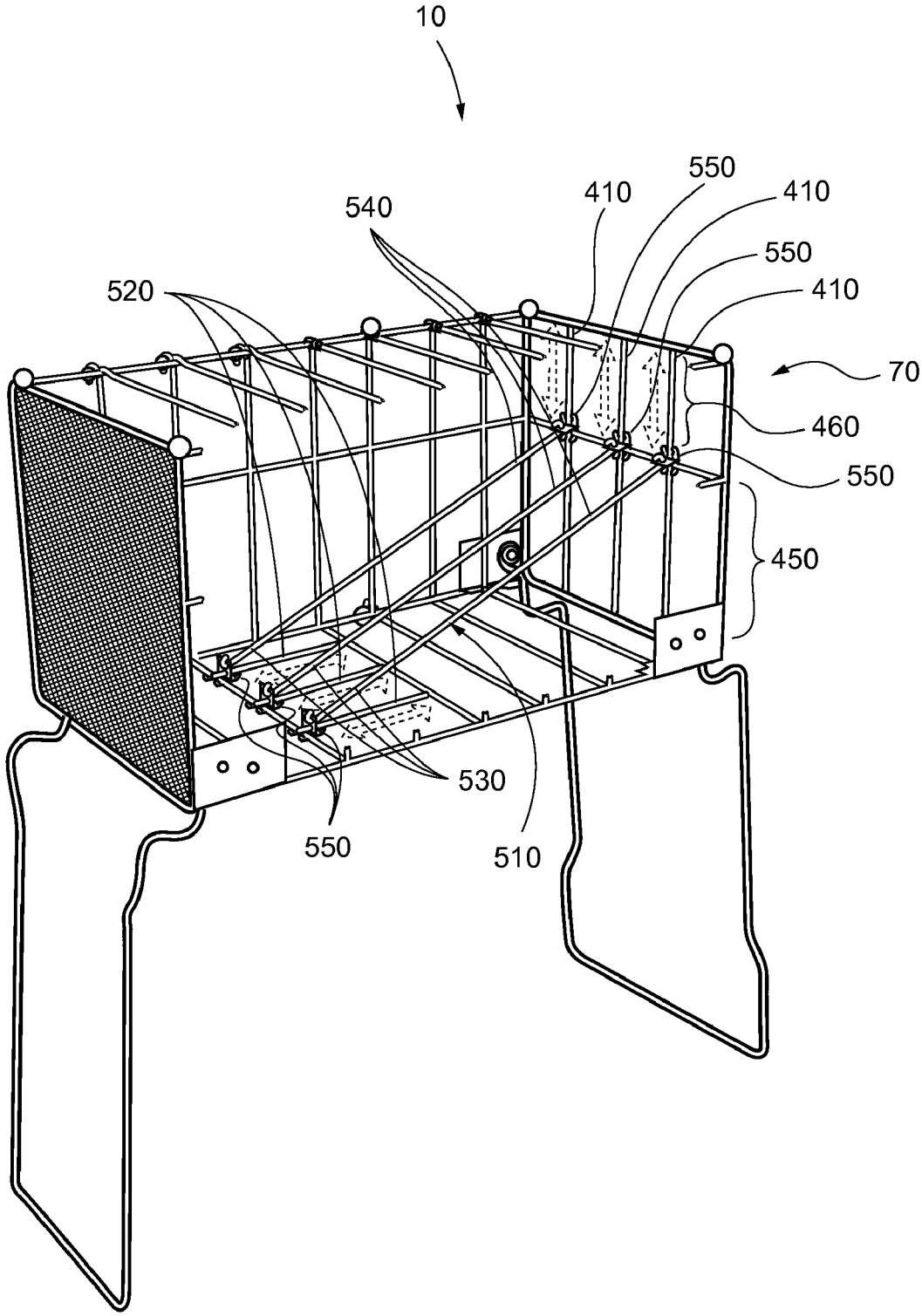
FIG. 7 is a cutaway side perspective view of an alternate embodiment of a ball hopper, showing an adjustable divider.

Referring now more specifically to FIG. 7, illustrated therein is another alternate embodiment of ball hopper 10, wherein the alternate embodiment of FIG. 7 is substantially equivalent in form and function to that of the embodiment detailed and illustrated in FIGS. 1A-5 except as hereinafter specifically referenced. Specifically, the alternate embodiment of FIG. 7 comprises adjustable divider 510, horizontal rods 520 and stoppers 550, wherein adjustable divider 510 comprise first ends 530 and second ends 540, and wherein first ends 530 and second ends 540 comprise stoppers 550 at the end thereof. To shift adjustable divider 510, first ends 530 of adjustable divider 510 shift horizontally along horizontal rods 520 and second ends 540 of adjustable divider 510 shift vertically along connectors 410 disposed on second end 70 of ball hopper 10, wherein stoppers 550 secure first ends 530 of adjustable divider 510 on horizontal rods 520, and wherein stoppers 550 secure second ends 540 of adjustable divider 510 on connectors 410, thereby allowing a user to adjust the size of storage section 450 and ball section 460 of ball hopper 10.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A ball hopper comprising:

a frame, wherein said frame comprises a lower portion, a middle portion, an upper portion and at least one rigid connector joining said lower portion, said middle portion and said upper portion;

a divider, wherein said divider separates said frame into a lower compartment and an upper compartment, and wherein said divider slopes from said upper portion to said middle portion of said frame;

a plurality of elastic members, wherein each of said plurality of elastic members are selectively secured to said lower portion of said frame; and a seat.

2. The ball hopper of claim 1, wherein said lower portion of said frame further comprises at least one lower hook, and wherein said upper portion of said frame further comprises at least one upper hook.

3. The ball hopper of claim 2, further comprising at least one upper elastic member disposed on said upper portion of said frame, wherein said at least one upper elastic member comprises a first end and a second end, and wherein said first end and said second end are selectively secured to at least one point disposed on said upper portion of said frame.

4. The ball hopper of claim 3, wherein said second end of said at least one upper elastic member comprises a upper retention sphere at the end thereof, and wherein said upper retention sphere selectively attaches to and un-hooks from said upper hook to access said upper compartment of said frame.

5. The ball hopper of claim 3, wherein said at least one upper elastic member is adjustable in length.

6. The ball hopper of claim 1, wherein said plurality of elastic members comprises a first end and a second end, and wherein said first end is permanently secured to said lower portion of said frame.

7. The ball hopper of claim 6, wherein said second end of said plurality of elastic members comprise lower retention spheres at the end thereof, and wherein said lower retention spheres selectively attach to and un-hook from said at least one lower hook to access said lower compartment of said frame.

8. The ball hopper of claim 1, wherein said plurality of elastic members are adjustable in length.

9. The ball hopper of claim 1, further comprising a first handle and a second handle disposed on said frame, wherein said first handle and said second handle are adjustable to selected angles, and wherein said second handle is wider than said first handle.

10. The ball hopper of claim 9, wherein said selected angles are selected from the group consisting of upright position, collapsed position and inwardly leaning position, and combinations thereof.

11. The ball hopper of claim 1, wherein said frame further comprises a first end, and wherein said first end side comprises a mesh panel, and wherein said seat comprises said mesh panel.

12. The ball hopper of claim 1, wherein said plurality of elastic members comprise first ends and second ends, and wherein said first ends and said second ends of said plurality of elastic members comprise a mechanism for securing said first ends and said second ends of said plurality of elastic members to said lower portion of said frame.

13. The ball hopper of claim 12, wherein said mechanism comprises a loop.

14. The ball hopper of claim 13, wherein said mechanism further comprises a fastener, and wherein said fastener wraps around said loop.

15. The ball hopper of claim 1, wherein said lower portion of said frame further comprises a plurality of feet, and wherein said plurality of feet prevent damage to said plurality of elastic members when said ball hopper is in use.

16. The ball hopper of claim 1, wherein said divider comprises a first end and a second end, and wherein said first end is disposed on said at least one rigid connector on said upper portion of said frame, and wherein said second end is disposed on said middle portion of said frame.

17. The ball hopper of claim 16, wherein said divider is adjustable via a mechanism, and wherein said mechanism selectively adjusts the position of said divider via stoppers, thereby selectively altering the area of said lower compartment and said upper compartment.

18. A method of collecting and distributing objects, wherein said method comprises the steps of:

obtaining a ball hopper, wherein said ball hopper comprises a frame, and wherein said frame comprises a divider, a plurality of elastic members, handles, a lower portion, a middle portion, an upper portion, a seat and at least one rigid connector joining said lower portion, said middle portion and said upper portion, and wherein said divider separates said frame into a lower compartment and an upper compartment, and wherein said plurality of elastic members are selectively secured to said lower portion of said frame, and wherein at least one upper elastic member is disposed on said upper portion of said frame, and wherein said handles are disposed on said upper portion of said frame;

selectively unhooking said at least one upper elastic member from said upper portion of said frame and storing personal items in said upper compartment;

selectively re-hooking said at least one upper elastic member to said upper portion of said frame, thereby securing said personal items in said upper compartment;

securing said handles in an inwardly leaning position; and pressing said frame over an object, wherein said pressing causes forces to be exerted on said at least one elastic member, and wherein said at least one elastic member moves open to a width which allows said object to enter said lower compartment of said frame.

19. The method of claim 18, wherein said plurality of elastic members comprise second ends, said method further comprising the steps of:

rotating said handles into an upright position and away from said frame, wherein said handles support said ball hopper on a surface;

unhooking said plurality of elastic members from said lower portion of said frame;

removing said object from said lower compartment of said frame; and re-hooking said second ends of said plurality of elastic members to said lower portion of said frame.

20. The method of claim 18, said method further comprising the steps of:

rotating said handles toward said frame into a collapsed position;

selectively rotating said frame, wherein said seat of said frame is parallel to the ground;

sitting on said seat;

un-hooking said plurality of elastic members from said lower portion of said frame;

removing said objects from said lower compartment of said frame; and re-hooking said plurality of elastic members to said lower portion of said frame.

21. The method of claim 18, wherein said ball hopper further comprises handle plates having wheels, and wherein said handles further comprise hinges, said method further comprising the steps of:

rotating one of said handles into the collapsed position;

rotating one of said handles into the upright position;

rotating said one of said handles in the upright position about its said hinges; and pulling said ball hopper via said one of said handles in the upright position, wherein said ball hopper is transported to a different location via said wheels.

* * * * *